US005820233A

United States Patent [19]

Hahn

[11] Patent Number: 5,820,233

[45] Date of Patent: Oct. 13, 1998

[54] CABINET FOR DISPLAYING OBJECTS

[75] Inventor: Thomas Hahn, Frankfurt am/Main, Germany

[73] Assignee: Glasbau Hahn GmbH & Co. KG, Germany

[21] Appl. No.: 755,965

[22] Filed: Nov. 25, 1996

[30] Foreign Application Priority Data

Nov. 23, 1995 [DE] Germany ..... 195 43 615.6

[51] Int. Cl.[6] ..... A47F 3/00

[52] U.S. Cl. ..... 312/114; 312/312; 312/137

[58] Field of Search ..... 312/114, 319.5, 312/319.8, 319.7, 205, 312, 196, 296, 140.1, 140.4, 137, 117

[56] References Cited

FOREIGN PATENT DOCUMENTS 2 619 695 3/1989 France .

*Primary Examiner*—Jose V. Chen
*Assistant Examiner*—Janet M. Wilkens
*Attorney, Agent, or Firm*—Haynes and Boone, L.L.P.

[57] ABSTRACT

A cabinet has a top part (1) consisting of glass sheets and an under part (8), wherein the top part (1) is composed of a top face (2) and a plurality of sides (3, 4, 5 and 6). A screw jack (10) driven by an electric motor (11) is fitted in each corner in the under part (8) to raise the top part (1). Synchronous running of all the electric motors (11) during the raising or lowering operation of the top part (1) is ensured by a common electronic control device (12) which is fitted in the under part (8).

9 Claims, 4 Drawing Sheets

CABINET FOR DISPLAYING OBJECTS

BACKGROUND OF THE INVENTION (1) Field of the Invention

This invention relates to a cabinet for displaying objects, consisting of a top part and an under part, wherein the top part is formed from a top face and at least three sides consisting of glass, or which each two are fixedly connected together at their respective vertical end faces.

(2) Description of the Prior Art

Such cabinets are already known for displaying objects. The top part consists at least of three sides consisting of glass. The plan of such cabinets can be triangular, rectangular or even polygonal. Access to the interior enclosed by the top part of the cabinet is effected by removing the top part from the under part in the case of small and thus light top parts, or through a door in one side and the whole side can be formed as a door. Pivoted or even sideways sliding doors can be envisaged.

If now there is a requirement with such a cabinet for airtight closure of the interior relative to the air surrounding the cabinet, the door or its frame must be provided with suitable sealing means, so that the necessary air-tightness of the cabinet is obtained in the closed state of the door. If the whole top part consists of glass sheets, such a door and especially its hinges or guides also spoil the overall optical impression of the cabinet.

A cabinet is described in FR-A 2 619 695, in which the top part consisting of glass sheets can be raised and lowered again by an electric lift device fitted in the under part. The two side parts are extended at the sides adjacent the under part in correspondence with the maximum height of the top part in the raised state and are received by the under part in the lowered state of the top part. The electric lift device acts on the lower edge of the two side parts. A disadvantage in the known cabinet is the height of the under part, in which the extensions of the two side parts must be accommodated in the lowered state of the top part, in addition to the electric lift device. The under part is thus than higher than the top part is to be raised in order to achieve good accessibility to the interior enclosed in the lowered state of the top part. The accessibility of the shelf surface of this known cabinet is restricted in that the extended side parts make access to the shelf surface from the side impossible even in the raised state of the top part. Furthermore airtight closure of the interior is problematic in this known cabinet on account of the extended side pans.

SUMMARY OF THE INVENTION

The object of the invention consists in providing such a cabinet in which it is possible to dispense with a door in the top part of the cabinet.

This object is met in that where each two sides abut there is fitted the end of a screw jack driven by an electric motor and fixed on the under part, and in that the electric motors are provided with a common electronic control device, which so controls the electric motors that these raise the top part uniformly from the closed state of the cabinet and lower it uniformly from the open state of the cabinet.

By using a screw jack drive for moving the top part up and down it is possible easily to make also large cabinets with a correspondingly heavy top part with an airtight interior, since the air-tightness can easily be achieved in the closed state of the cabinet by a surrounding seal between the lower edges of the interfaces of the sides and the under part, also with the weight of the top part pressing on the under part. By using motor-driven screw jacks for raising and lowering the top part. even heavy top parts of cabinets can easily be opened and closed by one person.

Advantageous developments of the invention will appear from the dependent claims.

DESCRIPTION OF THE PREFERRED EMBODIMENT

Figure 1:
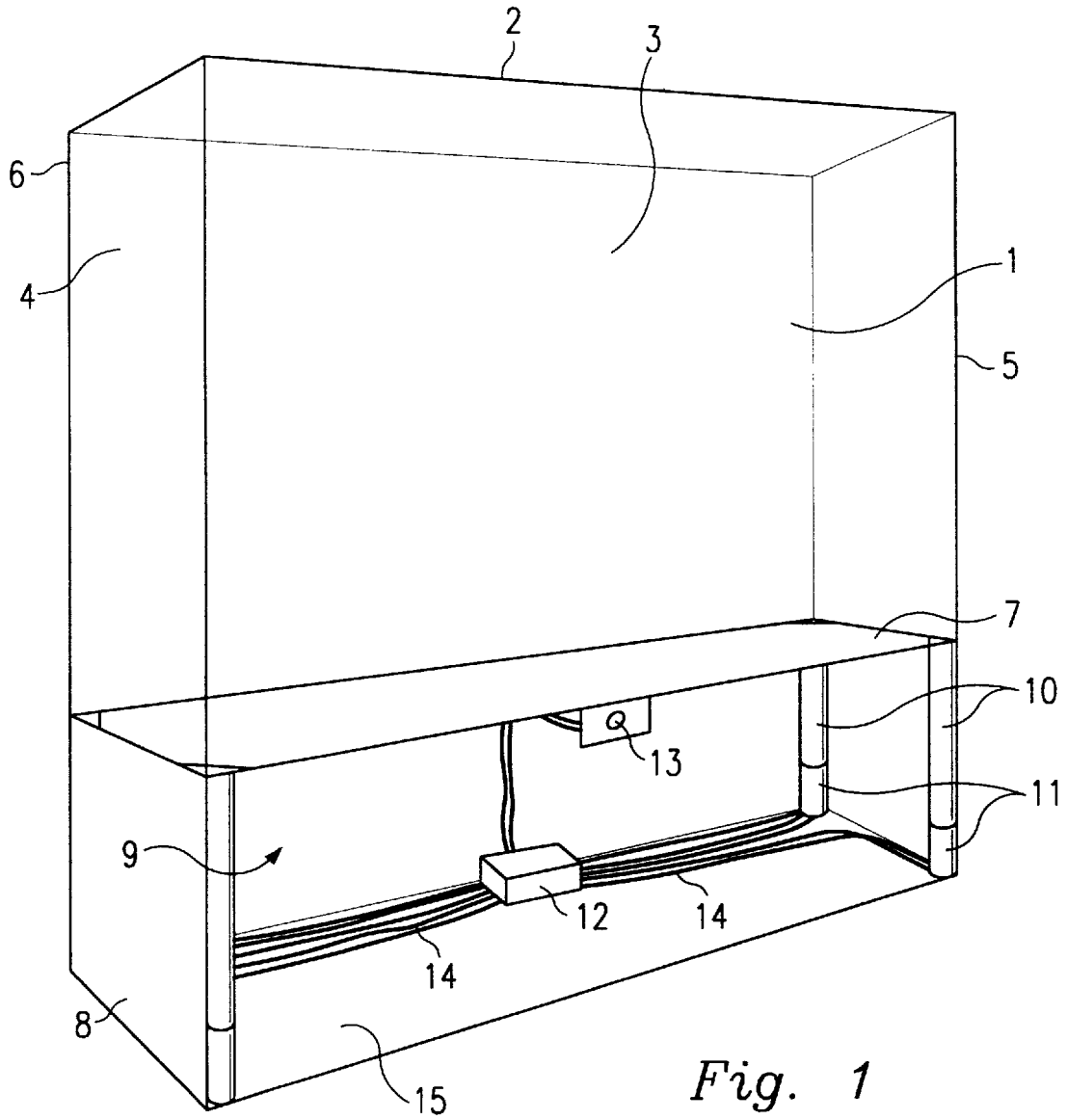
FIG. 1 is a perspective view of a cabinet.

FIG. 1 shows a cabinet with an upper portion or a top part 1 consisting of an upper face 2, a front side 3, side members such as left side 4, a right side 5, and a rear side 6, wherein part or all of the faces consist of glass and these are fixedly connected together at their respective end edges. The top part 1 sits on a lower portion or an under part 8 which is closed at the top by a shelf surface 7. In between a bottom 15, on which the under part 8 rests, and the shelf surface 7 there are side parts of opaque material, which together with the shelf surface 7 and the bottom 15 form a space 9 inside the under part 8. One or more side parts of the under part 8 are removable or are formed as doors, in order to provide access to the space 9. The cabinet is so constructed that the sides 3, 4, 5 and 6 are aligned with the corresponding side parts of the under part 8 in the closed state of the cabinet, i.e. when the top part 1 rests on the under part 8.

In the closed state of the cabinet, i.e. when the top part 1 rests on the under part 8, the interior of the cabinet which receives the objects to be displayed, is closed off from the surroundings in airtight manner. This is done for example by a surrounding sealing strip fitted on the upper side of the under part 8, on which the respective edges of the sides 3, 4, 5 and 6 facing the under part 8 bear in the closed state of the cabinet.

A screw jack 10 is fitted in the space 9 of the under part 8 at each of the corners thereof and is driven by an electric motor 11. The upper and movable end of the screw jack 10 is fixed to the underside of the top part 1 at the corresponding corner, in such a way that the upper end of the screw jack 10 and its attachment to the top part 1 are largely invisible in the closed state of the cabinet.

Figure 3:
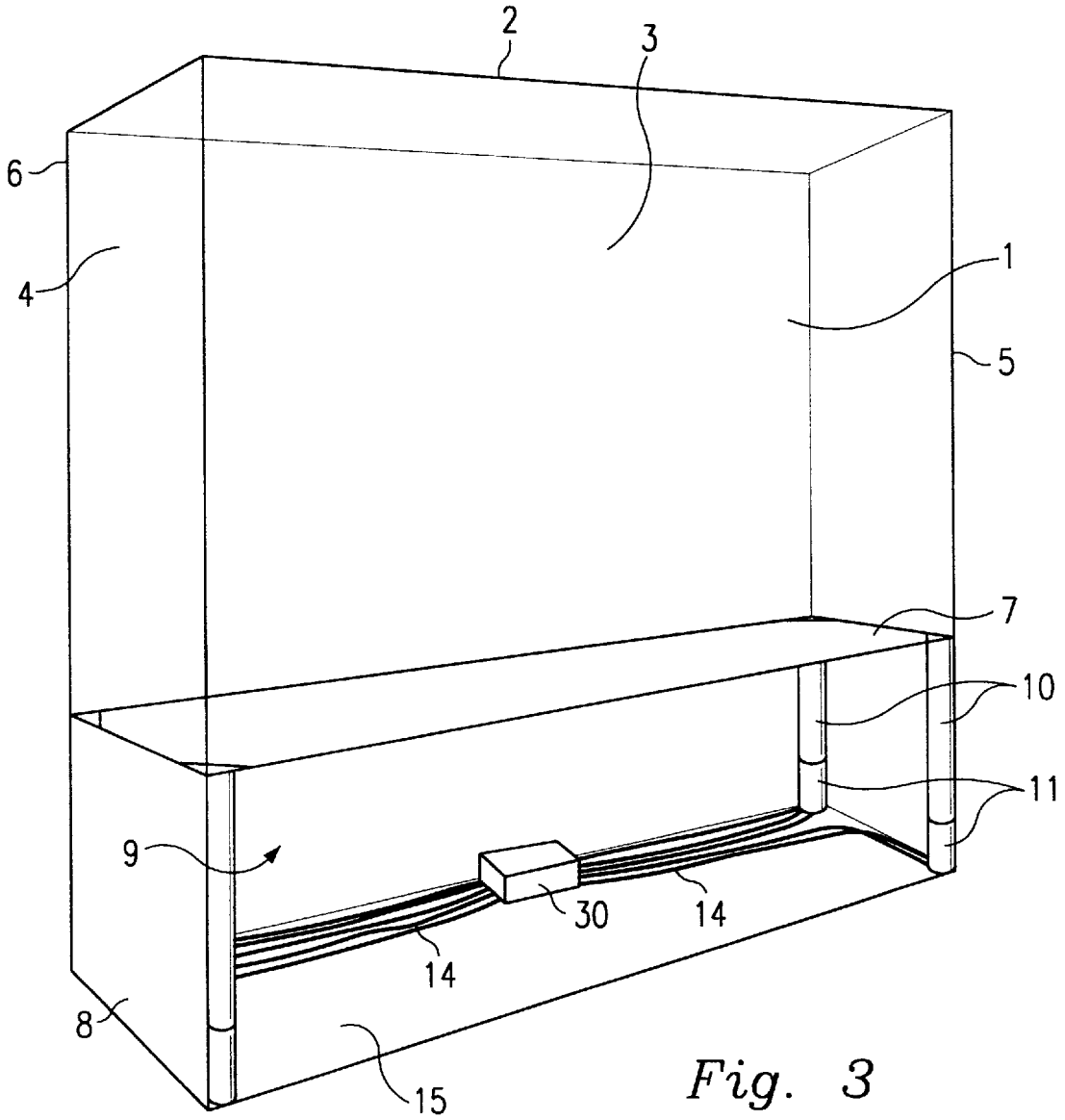
FIG. 3 is a perspective view of the cabinet of FIG. 1 with an wire-free control unit.

The electric motors 11 of the screw jacks 10 are connected through cables 14 to an electronic control device 12 which ensures synchronous running of all of the electric motors 12, so that the top part 1 is uniformly raised from the under part 8 or lowered, i.e. is moved up or down. The desired movement of the top part 1 is controlled by a switch 13, which is fitted on the under part 8, accessible from the outside and connected to the electronic control device 12 by a further cable 14. A wire-free electronic control unit 30, as shown in FIG. 3, can be envisaged instead of the switch 13. The electronic control device 12 gets its energy advantageously from the mains supply or even from a rechargeable battery.

As well as control of synchronous running of the electric motors, the electronic control device 12 has the purpose of monitoring the current drawn by each electric motor 11. If overstepping of a predetermined value is detected, the current supply to the electric motor 11 in question is interrupted by the electronic control device 12. Overstepping the predetermined value of the current drawn can be caused by reaching one of the two limit positions of the screw jack 10 for example. If the weight of the top part 1 is not large enough in order to press it on to the surrounding sealing strip so as to obtain an adequate seal, a screw jack can be selected with a retracted length such that it cannot attain its limit position in the retracted state, so that the overstepping of the predetermined current value is not obtained by reaching the limit position but by the pressure of the top part 1 on the under part 8 by the screw jack 10. In this case it is also conceivable to provide different threshold values for the two limit positions in the electronic control device 12.

In order to make the interior of the top part accessible from outside, it is necessary for the top part 1 to be raised as high as possible from the under part 8, especially when tall display objects are involved, which are to be placed on the shelf surface 7 for display or which are to be removed therefrom. In those cases in which the cabinet is formed as a table cabinet, the under part 8 affords a sufficiently large structural height for the screw jacks 10, which can each also be fitted in a table leg if the under part 8 is not closed in. Difficulties in fitting the screw jacks 10 arise when the under part 8 only has a small height. In this case it is conceivable to fit a telescopic screw jack with a flexible drive spindle, whose length in the extended state corresponds to more than twice the length of the screw jack in the retracted state.

Figure 2:
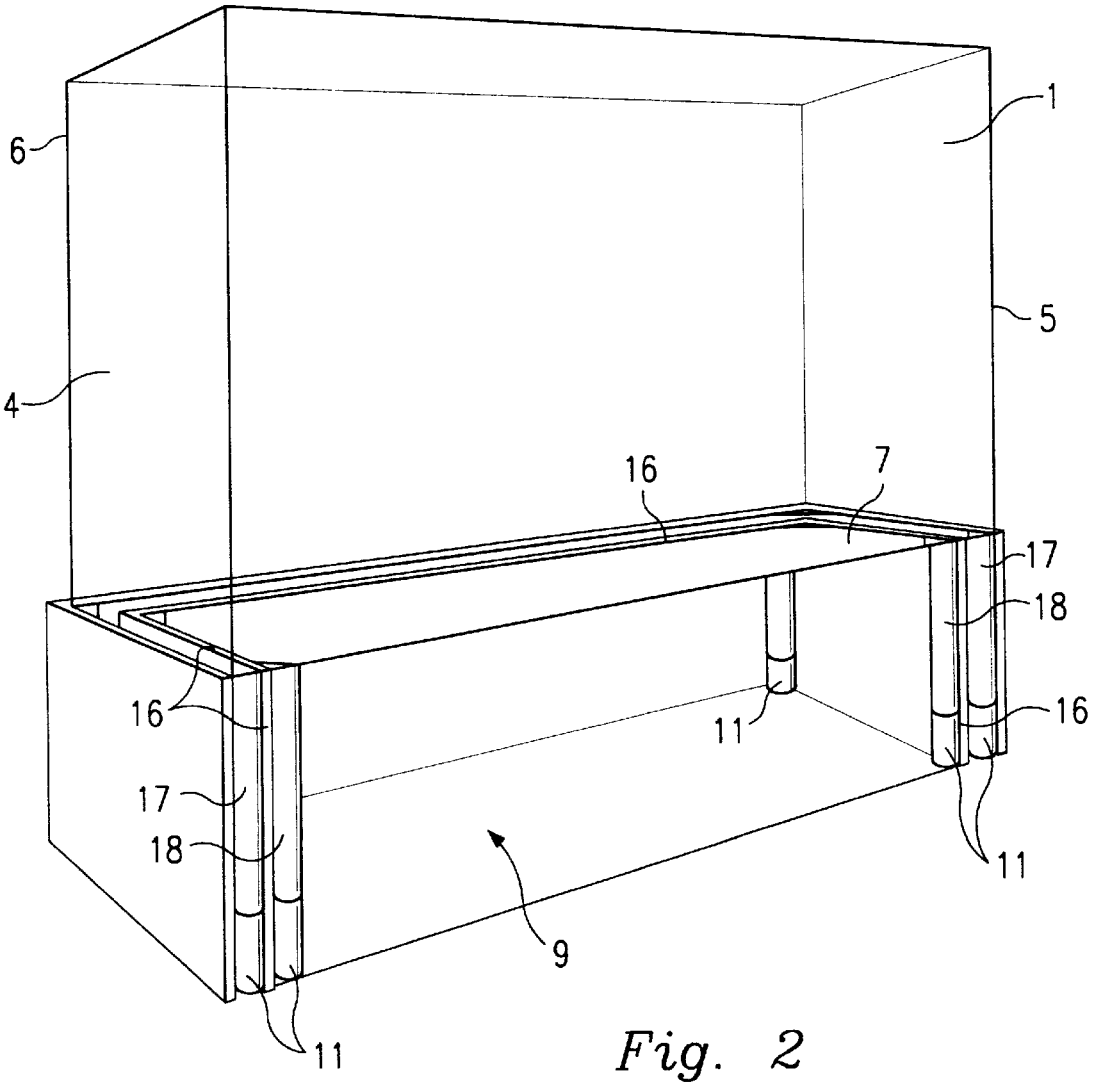
FIG. 2 is a perspective of the cabinet of FIG. 1 with an auxiliary frame.
Figure 4:
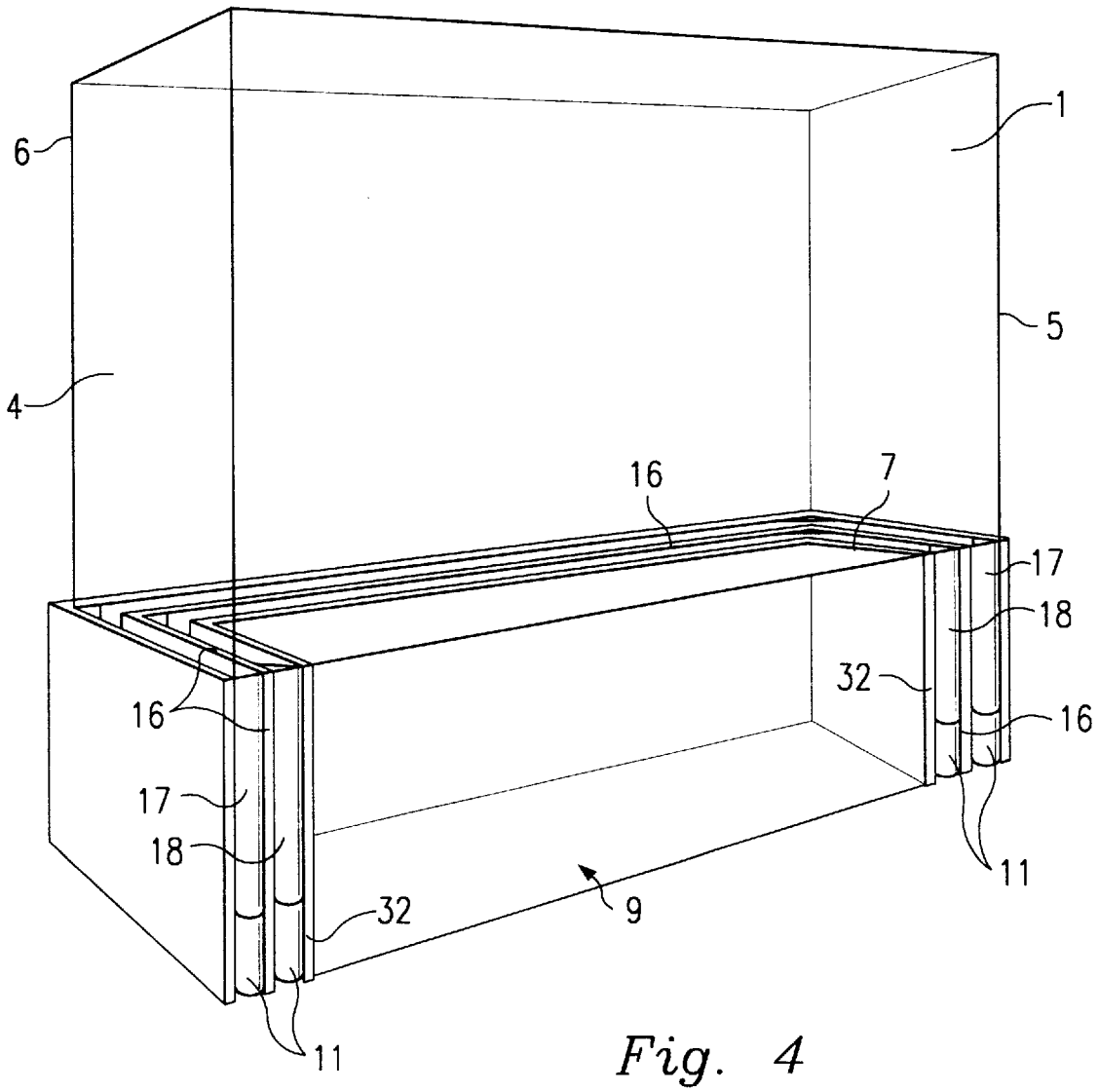
FIG. 4 is a perspective view of the cabinet of FIG. 2 with a second auxiliary frame.

FIG. 2 shows a further possibility for getting an adequate lift height for the top part 1 consists in the use of one or more auxiliary frames 16 where this is provided in the region of the bottom edge of the left side 4, the right side 5 and the rear side 6. In this manner the access to the interior of the top part 1 is unimpeded at least from the front side. The top side of the auxiliary frame 16 should lie flush with the shelf surface 7 in the closed state of the cabinet, so that it is largely invisible. A screw jack 17 with its electric motor is now fitted in each case on the auxiliary frame 16 while attachment of the movable ends of the screw jacks to the top part 1 is effected in the manner already described. A further screw jack 18 with its electric motor 11 is fixed in each case on the under part 8 in the space 9, with its moving end engaging the auxiliary frame 16. A lift height can be attained with this arrangement which corresponds to twice the lift height of one screw jack 10. By using further auxiliary frames, such as auxiliary frame 32 of FIG. 4, with associated drive screw jacks, still greater lift heights can be attained. The raising operation of the top part 1 is so controlled by the electronic control device (not shown) that the top part is raised first and only after reaching the limit position is the auxiliary frame 16 raised. The lowering of the top part 1 takes place correspondingly.

A further possibility for achieving a large lift height can also consist in arranging a tube for example fitted on the under part 8 in each of the four corners of the top part 1, with a second tube therein fixed on the underside of the top face 2, with a screw jack and a drive motor. During the raising operation by the screw jacks, the second tube is pushed out of the first tube by the screw jack and thus the top part 1 is raised from the under part 8. The lowering operation takes place correspondingly.

The invention is not limited to cabinets with a rectangular plan; rather cabinets with a triangular plan or with a polygonal plan can be fitted with the lift device according to the invention. It only has to be ensured that the top part is supported by the screw jacks in a stable position. Thus three drive screw jacks are adequate for example with a cabinet having a hexagonal plan.

I claim:

1. A cabinet for displaying objects, consisting of a top part and an under part, wherein the top part is formed from a top face and at least three sides consisting of glass, of which each two of the at least three sides are fixedly connected together at their respective vertical end faces, wherein, where each two sides abut there is fitted the end of a screw jack driven by an electric motor and fixed on the under part, and in that the electric motors are provided with a common electronic control device, which so controls the electric motors that the electric motors raise the top part uniformly from a closed state of the cabinet and lower it uniformly from an open state of the cabinet.

2. The cabinet according to claim 1, wherein a switch is connected to the electronic control device to control the up and down movement of the top part.

3. The cabinet according to claim 1, wherein control of the up and down movement of the top part is effected free from wires.

4. The cabinet according to claim 3, wherein each screw jack can be extended by more than twice its length.

5. The cabinet according to claim 1, wherein an auxiliary frame is provided in a region of a bottom edge of a rear side, a left side and a right side of the top part wherein each of the screw jacks engages the auxiliary frame and wherein a second screw jack drive is fitted on the auxiliary frame, through which the auxiliary frame can be raised and lowered.

6. The cabinet according to claim 5, further comprising a second auxiliary frame.

7. A cabinet for displaying objects and comprising:

an upper portion formed by a top face, a first side member and two additional side members fixedly connected to the first side member at their respective vertical end faces;

a lower portion for supporting the upper portion;

at least two screw jacks the respective ends of which engage the side members where the two additional side members are connected to the first side member;

at least one electric motor disposed in the lower portion for driving the screw jacks; and a control device for controlling the electric motors to move the upper portion relative to the lower portion between an open and closed position control unit.

8. The cabinet according to claim 7, further comprising a switch connected to the control device to control up and down movement of the upper portion.

9. The cabinet according to claim 7, wherein control of up and down movement of the upper portion is effected free from wires.

* * * * *

UNITED STATES PATENT AND TRADEMARK OFFICE

CERTIFICATE OF CORRECTION

PATENT NO. : 5,820,233

DATED : October 13, 1998

INVENTOR(S) : Thomas Hahn

It is certified that error appears in the above-identified patent and that said Letters Patent is hereby corrected as shown below:

Column 1, line 41, "thus than higher than" should be –thus higher than--

Signed and Sealed this

Seventh Day of September, 1999

*Attest:*

Q. TODD DICKINSON

*Attesting Officer*

*Acting Commissioner of Patents and Trademarks*